US005858134A

United States Patent [19]

Bechet et al.

[11] Patent Number: 5,858,134

[45] Date of Patent: Jan. 12, 1999

[54] PROCESS FOR PRODUCING ALSIMGCU ALLOY PRODUCTS WITH IMPROVED RESISTANCE TO INTERCRYSTALLINE CORROSION

[75] Inventors: Denis Bechet, Saint Egreve; Timothy Warner, Voreppe, both of France

[73] Assignee: Pechiney Rhenalu, Courbevoie, France

[21] Appl. No.: 809,704

[22] PCT Filed: Oct. 24, 1995

[86] PCT No.: PCT/FR95/01412

§ 371 Date: Apr. 4, 1997

§ 102(e) Date: Apr. 4, 1997

[87] PCT Pub. No.: WO96/12829

PCT Pub. Date: May 2, 1996

[30] Foreign Application Priority Data

Oct. 25, 1994 [FR] France ..... 94 13047

[51] Int. Cl.[6] ..... C22F 1/04

[52] U.S. Cl. ..... 148/550; 148/689; 148/690; 148/439; 148/700; 148/701

[58] Field of Search ..... 148/550, 700, 148/689, 690, 439, 701; 420/534, 535, 537, 541, 543, 544, 551, 553

[56] References Cited

U.S. PATENT DOCUMENTS

| | | | |
|---|---|---|---|
| 4,082,578 | 4/1978 | Evancho et al. | 148/439 |
| 4,424,084 | 1/1984 | Chisolm . | |
| 4,490,189 | 12/1984 | Develay | 148/690 |
| 4,589,932 | 5/1986 | Park . | |
| 4,614,552 | 9/1986 | Forlin . | |
| 4,711,762 | 12/1987 | Vernam et al. | 148/439 |
| 5,503,690 | 4/1996 | Wade et al. | 148/689 |
| 5,616,189 | 4/1997 | Jin et al. | 148/439 |
| 5,643,372 | 7/1997 | Sainfort et al. | 148/698 |

FOREIGN PATENT DOCUMENTS

| | | |
|---|---|---|
| 173632 | 3/1986 | European Pat. Off. . |
| 2360684 | 3/1978 | France . |
| 2683828 | 5/1993 | France . |
| 60-082643 | 5/1985 | Japan . |
| 5-070907 | 3/1993 | Japan . |
| 6-136478 | 5/1994 | Japan . |
| 9527091 | 10/1995 | WIPO . |

OTHER PUBLICATIONS

W. Hufnagel, 'Aluminium Taschenbuch' 1986, Aluminium Verlag, pp. 138–147.

J. E. Hatch 'Aluminum' 1984, Am Soc for Metals, pp. 177–182.

*Primary Examiner*—Margery Phipps

*Attorney, Agent, or Firm*—Dennison, Meserole, Pollack & Scheiner

[57] ABSTRACT

The invention concerns a process for the production of rolled or extruded products of high strength AlSiMgCu aluminium alloy with good intergranular corrosion resistance, comprising the following steps:

casting a plate or billet with the following composition (by weight):

Si: 0.7–1.3%
Mg: 0.6–1.1%
Cu: 0.5–1.1%
Mn: 0.3–0.8%
Zr: <0.20%
Fe: <0.30%
Zn: <1%
Ag: <1%
Cr: <0.25% other elements: <0.05% each and <0.15% in total remainder: aluminium; with: Mg/Si<1 homogenising in the range 470° C. to 570° C.;

hot working, and optionally cold working;

solution heat treating in the range 540° C. to 570° C.;

quenching;

annealing, comprising at least one temperature plateau in the range 150° C. to 250° C., preferably in the range 165° C. to 220° C., the total period measured as the equivalent time at 175° C. being in the range 30 h to 300 h.

13 Claims, No Drawings

PROCESS FOR PRODUCING ALSIMGCU ALLOY PRODUCTS WITH IMPROVED RESISTANCE TO INTERCRYSTALLINE CORROSION

FIELD OF THE INVENTION

The invention concerns high strength AlSiMgCu aluminium alloy products designated by the 6000 series of the international nomenclature of the "United States Aluminum Association", for structural applications, in particular in the aeronautical industry.

DESCRIPTION OF RELATED ART

Some alloys in the 6000 series have superior properties which render them suitable for the most demanding structural applications.

Thus United States patent U.S. Pat. No. 4,082,578 from ALCOA describes two families of alloys, subsequently registered with the Aluminum Association and designated 6009 and 6010, the first with superior formability and the second with superior mechanical strength. These alloys have good dent resistance, stress corrosion resistance and exfoliation resistance, as well being well suited to resistance spot welding. They are thus particularly suitable for automobile construction (bodywork and bumpers).

These alloys have the following composition (by weight):

Si: 0.4–1.2%

Mg: 0.4–1.1%

Cu: 0.1–0.6%

Mn: 0.2–0.8%

Fe: 0.05–0.35%

In some cases, in the T6 temper (in the Aluminum Association designation), an ultimate tensile strength $R_m$ of 400 MPa and a yield strength of 370 MPa at 0.2%, $R_{0.2}$, can be exceeded.

U.S. Pat. No. 4,614,552 from ALCAN concerns aluminium alloy sheets, also for automobile bodywork, with the following composition:

Si: 0.60–1.0%

Mg: 0.62–0.82%

Cu: 0.65–0.79%

Mn: 0.10–0.50%

Fe: <0.4%

Ti: <0.10%

Others: <0.05% each and <0.15% in total.

This alloy was subsequently registered under designation AA 6111. In common with alloys 6009 and 6010 above, it does not have good resistance to intercrystalline corrosion in the T6 temper.

U.S. Pat. No. 4,589,932 from ALCOA proposes an alloy for automobile, rail, naval or aeronautical construction which was subsequently registered under designation AA 6013, with the following composition:

Si: 0.4–1.2% preferably: 0.6–1%

Mg: 0.5–1.3% preferably: 0.8–1.2%

Cu: 0.6–1.1%

Mn: 0.1–1% preferably 0.2–0.8%

Fe: <0.5%

Cr: <0.10%

Ti: <0.10%

Zn: about 0.25%

The alloy is solution heat treated at 549° C. to 582° C., this temperature being close to the solidus temperature.

The sheets obtained compare vary favourably as regards yield strength and toughness, with coated alloy 2024 which is currently used for aircraft fuselages. Further, the manufacturing costs are lower.

However, some studies published in the scientific press have shown that this alloy has a high sensitivity to intercrystalline corrosion in the T6 temper (see T. D. Burleigh, "Microscopic Investigation of the Intergranular Corrosion of 6013-T6", in ICAA3, Trondheim 1992, p 435).

Our European patent EP-A-0 173 632 concerns extruded or forged products of an alloy with composition:

Si: 0.9–1.3% preferably: 1–1.15%

Mg: 0.7–1.1% preferably: 0.8–1%

Cu: 0.3–1.1% preferably 0.8–1%

Mn: 0.5–0.7%

Zr: 0.07–0.2% preferably 0.08–0.12%

Fe: <0.30%

Zn: <0.7% preferably 0.3–0.6% which has an essentially non re-crystallised structure.

That alloy, subsequently registered under designation AA 6056, has very good mechanical properties for both strength and ductility:

$$R_m > 420 \text{ MPa } R_{0.2} > 380 \text{ MPa } A > 10\%$$

Our studies have shown that this alloy is also sensitive to intercrystalline corrosion in the T6 temper, with analogous results to those of 6013 (see M. Reboul et al., "Stress Corrosion Cracking of High Strength Al Alloys), in ICAA3, Trondheim 1992, p 455).

SUMMARY OF THE INVENTION

It has been noticed that the use of a particular region within the composition range of 6000 alloys containing Si, Mg and Cu, combined with a particular intercrystalline corrosion desensitising treatment, can produce both mechanical properties equivalent to those of alloy 2024 in the T3 temper and a considerably improved resistance to intercrystalline corrosion in the non coated temper, meaning that alloys of this type treated in this fashion are particularly suitable for the production of aircraft fuselages and, more generally, to high strength structural applications.

The invention thus provides a process for the production of wrought products of high strength AlSiMgCu aluminium alloy with good intercrystalline corrosion resistance, comprising the following steps:

casting a plate or billet with the following composition (by weight):

Si: 0.7–1.3%

Mg: 0.6–1.1%

Cu: 0.5–1.1%

Mn: 0.3–0.8%

Zr: <0.20%

Fe: <0.30%

Zn: <1%

Cr: <0.25%

Ag: <1% other elements: <0.05% each and <0.15% in total remainder: aluminium; with: Mg/Si<1 homogenising said plate or billet at a temperature which is in the range 470° C. to 570° C.;

hot working, and optionally cold working;

solution heat treating at a temperature which is in the range 540° C. to 570° C.;

quenching;

annealing, comprising at least one temperature plateau in the range of 150° C. to 250° C., preferably in the range 165° C. to 220° C., for a period which is in the range 30 h to 300 h, preferably in the range 70 h to 120 h, measured as an in equivalent period at 175° C.

Preferably, annealing comprises a further temperature plateau at a higher temperature which is in the range 185° C. to 250° C., the equivalent period at 175° C. always being in the range of 30 h to 300 h for the total of the two plateaux.

The invention also provides a rolled or extruded aluminium alloy product with the composition mentioned above, which is desensitised to intercrystalline corrosion (in the sense of the U.S.A Defense Department standard MIL-H-6088) and, in the desensitised temper, with an electrical conductivity which is at least 0.5 MS/m greater than that measured for the T6 temper.

The invention also provides an aircraft fuselage element or a road or rail vehicle structural element formed from the products of the invention or products manufactured using the process of the invention.

DETAILED DESCRIPTION OF THE INVENTION

Alloys of the invention having a Mg/Si ratio of <1 have a rather higher silicon content since the Mg composition ranges are typical series 6000 alloys. It is surprising to obtain better intercrystalline corrosion resistance by increasing the Si content, since this is reputed to have the opposite effect. Thus Kemal Nisancioglu in SINTEF Report A 820/3 of 23/8/1982, "Intercrystalline, stress and exfoliation corrosion of AlMgSi alloys. A literature survey", ISBN 82-0595-2860-6, p. 7, mentions that "the tendency towards intercrystalline corrosion (in the T6 temper) increases with the Si content, especially for alloys in which Si is in excess with respect to the stoichiometric content".

It has been shown that with alloys in the same composition ranges, but with a Mg/Si ratio of >1, the special anneal does not produce satisfactory desensitisation to intercrystalline corrosion. In fact, traces of localised intercrystalline attack are observed. Desensitisation could doubtless be obtained, but at the cost of an unacceptable degradation in mechanical properties.

In alloys of the invention with a Mg/Si ratio of <1, desensitised to intercrystalline corrosion, numerous intergranular precipitates have been observed which are in the form of platelets, while these are more needle-like in shape in the T6 temper. At least some of these platelet shaped precipitates contain quaternary AlMgSiCu compounds.

Further, the desensitised alloys of the invention have an electrical conductivity which is at least 0.5 MS/m higher than the electrical conductivity in the T6 temper when the anneal which is carried out contains two plateaux, and by 1 MS/m when one plateau is employed.

The Cu content must be >0.5% for the alloy to have both sufficient mechanical properties and good thermal stability. Beyond 1.1%, there is a risk of stress corrosion problems and exfoliating corrosion appearing, thus reducing toughness, due to primary copper particles.

Addition of Zn in an amount which is in the range 0.15 to 1% has a positive influence on the intercrystalline corrosion resistance for an identical composition and anneal. Further, addition of of the order of 0.5% of Ag improves the mechanical properties.

The products of the invention can be rolled sheets or extruded profiles. The alloy is cast into plates (for sheets) or billets (for profiles) and the transformation procedure is relatively conventional until the final anneal. Homogenisation is carried out between 480° C. and 570° C. for a period which is in the range 5 to 50 h. Working by hot rolling or extruding, followed by cold rolling (for sheets) is then carried out to a thickness which is in the range 0.5 to 15 mm. Solution heat treatment is then carried out at a temperature which is close to the solidus, in the range 540° C. to 575° C., then water quenching at a cooling rate which depends on the thickness of the product.

The anneal is a particular heat treatment which produces both the required mechanical properties and desensitises the alloy to intercrystalline corrosion. This treatment can be either a single-plateau treatment at a temperature which is in the range 150° C. to 250° C., preferably in the range 165° C. to 220° C., or a two-plateau treatment, one of the plateaux being at a temperature which is in the range 150° C. to 250° C. (preferably 165° C. to 220° C.) and the other at a higher temperature, in the range 170° C. to 270° C.

The treatment period depends on the temperature. This period can be related to an equivalent period at 175° C., $t_{eq}$, linked to the temperature T of the plateau in °K and to the period t of treatment at that temperature (the temperature rise period being taken into account in the equivalent time calculation) by the relationship:

$$(t_{eq}/448)\exp(-Q/448R)=t/T\exp(-Q/RT)$$

where Q=145000 J/mol and R is the molar gas constant.

For two-plateaux treatments, it has been shown that desensitisation to intercrystalline corrosion is partial for $t_{eq}$>30 h and complete for $t_{eq}$>70 h. The term "partial desensitisation" means the absence of intercrystalline dendrites with a length of more than 20 microns in a polished cut carried out following the test carried out in accordance with American military standard ML-H-6088. Desensitisation is considered to be complete for an absence of dendrites which are over 5 microns in size.

An equivalent period of more than 120 h is not recommended as degradation of the yield strength is too severe, as it drops substantially below 300 MPa. The optimum for the desensitisation plateau is between 70 h and 120 h for two-plateau treatments and between 150 and 250 h for single-plateau treatment. Following annealing, the conductivity is always more than 0.5 MS/m higher than in the T6 temper.

A single-plateau heat treatment can also be carried out. However, to be effective, it must have an equivalent period which is longer than that for a two-plateau treatment, which generally leads to inferior mechanical properties. This equivalent period is preferably in the range 150 h to 250 h. In this case, the conductivity is at least 1 MS/m different from that of the T6 temper.

The products of the invention have a good yield strength and an excellent specific strength (ratio of strength over density), taking into account the fact that they have a lower density than that of 2000 alloys, for example. Thus for 1.6 mm thick sheets, a strength of 71 GPa was measured, barely less than the module for sheets of the same thickness of bare 2024 alloy, and substantially superior to that of coated 2024 which is normally used for the fuselage of commercial aircraft.

Because of a high temperature anneal, these products also have good thermal stability which makes them suitable, for example, for use in the fuselages of supersonic aircraft.

EXAMPLES

Example 1

An alloy plate was produced with the following composition:

Si: 0.79%

Mg: 0.94%

Cu: 1.0%

Mn: 0.58%

Fe: 0.22%

Zn: 0.15% giving a Mg/Si ratio of 1.2.

The plate was homogenised for 21 h at 530° C., scalped then hot rolled and cold rolled to a thickness of 1.6 mm Solution heat treatment was carried out at 550° C. for 1 h.

A standard anneal for such an alloy, carried out in the T6 temper, would have taken 8 h at 175° C. and the transverse mechanical properties in this case were:

yield strength $R_{0.2}$=375 MPa ultimate tensile strength $R_m$=417 MPa elongation A=14%.

The electrical conductivity was 24.0 MS/m.

Different heat treatments were carried out on these sheets to attempt to desensitise them to intercrystalline corrosion. This sensitivity was qualified by using either an "Interneutral" test corresponding to American military standard MIL-H-6088, or an internal test known as the "Interano" test, consisting of anodic attack of a sample for 6 h in a chloride-perchlorate medium and at a current density of 1 mA/cm$^2$, followed by micrographical examination.

The equivalent anneal temperatures and the results for the mechanical properties in the transverse direction and for intercrystalline corrosion are shown in Table 1.

Example 2

Two alloys, A and B, were produced with the following composition:

| | A | B |
|---|---|---|
| Si: | 0.95 | 0.82 |
| Mg: | 0.87 | 0.80 |

Cu: 0.80 1.0

Mn: 0.63 0.58

Fe: 0.20 0.21

Mg/Si: 0.91 0.98

The plates were homogenised for 21 h at 530° C., scalped then hot and cold rolled to a thickness of 1.6 mm. Solution heat treatment was carried out at 550° C. for 1 h for alloy A and at 570° C. for 1 h for alloy B. The standard anneal to produce the T6 temper was 8 h at 175° C. and the transverse mechanical properties were as follows:

For A $R_{0.2}$=350 MPa $R_m$=380MPa A=13%

For B $R_{0.2}$=363 MPa $R_m$=400 MPa A=14%

The conductivities in the T6 temper for alloys A and B were respectively 24.3 and 24.7 MS/m.

Different heat treatments were carried out on these sheets to attempt to desensitise them to intercrystalline corrosion. This sensitivity was qualified using the "Interneutral" and "Interano" accelerated tests.

The equivalent periods at 175° C., the transverse mechanical properties, electrical conductivity and sensitivity to intercrystalline corrosion are shown in Table 2 (for alloy A) and Table 3 (for alloy B).

Example 3

An alloy plate was produced with the following composition:

Si: 0.924

Mg: 0.860

Cu: 0.869

Mn: 0.550

Fe: 0.192

Zn: 0.152

Zr: 0.103

Ni: 0.017

Ti: 0.020

Cr: 0.004 giving a Mg/Si ratio of 0.93.

The plate was homogenised at 530° C., scalped then hot and cold rolled to a thickness of 35 mm. Solution heat treatment was carried out at 550°, followed by quenching. Samples which had undergone conventional annealing corresponding to a T6 temper were compared with samples which had undergone the intercrystalline corrosion desensitisation treatment of the invention, with a two-plateau anneal of 6 h at 175° C.+2 h at 220° C.

The mechanical properties, measured in the longitudinal and transverse-longitudinal directions, were as follows:

| | L direction | | | T-L direction | | |
|---|---|---|---|---|---|---|
| | $R_{0.2}$ MPa | $R_m$ MPa | A % | $R_{0.2}$ MPa | $R_m$ MPa | A % |
| T6 temper | 368 | 380 | 13.0 | 356 | 394 | 9.6 |
| of invention | 315 | 344 | 11.5 | 316 | 349 | 9.0 |

In the "Interano" and "Interneutral" tests, the samples which had been treated in accordance with the invention exhibited an absence of sensitivity to intercrystalline corrosion, in contrast to the T6 samples,.

The rolled or extruded and intercrystalline corrosion desensitised products of the invention are particularly suitable for the production of structural elements for aeronautics, in particular fuselages, and for road and rail vehicles.

TABLE 1

| HEAT TREATMENT | $t_{eq}$ (h) | $R_{0.2}$ (MPa) | $R_M$ (MPa) | A (%) | IC SENSITIVITY |
|---|---|---|---|---|---|
| 6 h 175° C. + 30 min 200° C. | 9.7 | 367 | 396 | 12.7 | yes |
| 6 h 175° C. + 2 h 200° C. | 20.8 | 363 | 386 | 11.9 | yes |
| 6 h 175° C. + 8 h 200° C. | 65.2 | 330 | 371 | 11.5 | yes |
| 6 h 175° C. + 30 min 220° C. | 21.8 | 326 | 379 | 11.8 | yes |
| 6 h 175° C. + 2 h 220° C. | 69.3 | 314 | 363 | 11.8 | yes |
| 6 h 175° C. + 30 min 250° C. | 119.4 | 304 | 348 | 11.3 | partial |
| 6 h 175° C. + 2 h 250° C. | 459.5 | 277 | 328 | 10.7 | partial |
| 100 h at 175° C. | 100 | 351 | 380 | 13 | yes |
| 8 h at 185° C. | 18.3 | 360 | 398 | 6.7 | yes |
| 8 h at 220° C. | 253.3 | 290 | 343 | 6 | yes |

TABLE 2

| HEAT TREATMENT | $t_{eq}$ (h) | $R_{0.2}$ (MPa) | $R_M$ (MPa) | A (%) | IC SENSITIVITY | σ MS/m |
|---|---|---|---|---|---|---|
| 6 h 175° C. + 4 h 200° C. | 35.6 | 322 | 370 | 11.4 | yes | 24.6 |

TABLE 2-continued

| HEAT TREATMENT | $t_{eq}$ (h) | $R_{0.2}$ (MPa) | $R_M$ (MPa) | A (%) | IC SENSI-TIVITY | σ MS/m |
|---|---|---|---|---|---|---|
| 6 h 175° C. + 8 h 200° C. | 65.2 | 319 | 361 | 10 | partial | 24.7 |
| 6 h 175° C. + 30 min 220° C. | 21.8 | 338 | 376 | 11.4 | yes | 24.5 |
| 6 h 175° C. + 2 h 220° C. | 69.3 | 310 | 349 | 10.1 | no | 25.1 |
| 6 h 175° C. + 30 min 250° C. | 119.4 | 288 | 331 | 10.1 | no | 25.8 |
| 6 h 175° C. + 2 h 250° C. | 459.5 | 241 | 300 | 10.2 | no | 26.7 |
| 8 h at 185° C. | 18.3 | 349 | 388 | 11.1 | yes | 24.3 |
| 8 h at 200° C. | 59.2 | 322 | 353 | 10.3 | partial | 24.7 |
| 8 h at 200° C. | 253.3 | 272 | 323 | 9.5 | no | 25.8 |

TABLE 3

| HEAT TREATMENT | $t_{eq}$ (h) | $R_{0.2}$ (MPa) | $R_M$ (MPa) | A (%) | IC SENSI-TIVITY | σ MS/m |
|---|---|---|---|---|---|---|
| 6 h 175° C. + 2 h 220° C. | 69.3 | 313 | 374 | 11 | partial | 25.1 |
| 6 h 175° C. + 30 min 250° C. | 119.4 | 282 | 345 | 11 | no | 25.4 |

What is claimed is:

1. A process for the production of high strength AlSiMgCu aluminium alloy products with good intergranular corrosion resistance, comprising the following steps:

casting a plate or billet with the following composition (by weight):

Si: 0.7–1.3%

Mg: 0.6–1.1%

Cu: 0.5–1.1%

Mn: 0.3–0.8%

Zr: <0.20%

Fe: <0.30%

Zn: <1%

Ag: <1%

Cr: <0.25% other elements: <0.05% each and <0.15% in total remainder: aluminium; with: Mg/Si<1 homogenising in the range 470° C. to 570° C.;

hot working, and optionally cold working;

solution heat treating in the range 540° C. to 570° C.;

quenching;

annealing, comprising at least one temperature plateau in the range 150° C. to 250° C., for a total period, measured as an equivalent period at 175° C., in the range about 59 to 300 h.

2. A process according to claim 1, wherein Zn is present in a range of 0.15% to 1%.

3. A process according to claim 1, wherein the annealing comprises a plateau at said at least one temperature which is in the range 150° C. to 250° C., and a further plateau at a higher temperature which is in the range 170° C. to 270° C.

4. A process according to claim 3, wherein the equivalent period at 175° C. is in the range 30 h to 120 h.

5. A process according to claim 4, wherein the equivalent period at 175° C. is in the range 70 h to 120 h.

6. A process according to claim 1, wherein the annealing comprises a single plateau and its equivalent period at 175° C. is in the range 150 h to 250 h.

7. A rolled or extruded product of high strength AlSiMgCu aluminium with the following composition (by weight):

Si: 0.7–1.3%

Mg: 0.6–1.1%

Cu: 0.5–1.1%

Mn: 0.3–0.8%

Zr: <0.20%

Fe: <0.30%

Zn: <1%

Ag: <1%

Cr: <0.25% other elements: <0.05% each and <0.15% in total with: Mg/Si<1, which has been desensitised to intercrystalline corrosion within the meaning of standard MIL-H-6088, and has an electrical conductivity which is at least 0.5 MS/m higher than that measured for said composition in T6 temper.

8. An aircraft fuselage element formed from rolled or extruded products produced by a process according to claim 1.

9. An aircraft fuselage element formed from rolled or extruded products according to claim 7.

10. A structural element for a rail or road vehicle produced from rolled or extruded products produced by the process of claim 1.

11. A structural element for a rail or road vehicle formed from products according to claim 7.

12. A process according to claim 1, wherein said at least one temperature plateau is in the range of 165° C. to 220° C.

13. A process according to claim 3, wherein said plateau is in the range of 165° C. to 220° C.

* * * * *